US008215410B2

(12) United States Patent
Jackson et al.

(10) Patent No.: US 8,215,410 B2
(45) **Date of Patent: *Jul. 10, 2012**

(54) APPARATUS AND METHOD FOR ELECTRICAL PACKER FEEDTHROUGH

(75) Inventors: Roy Jackson, Houston, TX (US); Jeffrey W. Harvill, Sr., Keithville, LA (US); Michael G. Colescott, Galveston, TX (US)

(73) Assignee: Power Feed-Thru Systems & Connectors, LLC, Deer Park, TX (US)

( * ) Notice: Subject to any disclaimer, the term of this patent is extended or adjusted under 35 U.S.C. 154(b) by 483 days.

This patent is subject to a terminal disclaimer.

(21) Appl. No.: 12/246,196

(22) Filed: Oct. 6, 2008

(65) Prior Publication Data

US 2009/0090517 A1 Apr. 9, 2009

Related U.S. Application Data

(60) Provisional application No. 60/978,203, filed on Oct. 8, 2007.

(51) Int. Cl.
*E21B 19/00* (2006.01)

(52) U.S. Cl. ..... 166/385; 166/65.1; 166/188

(58) Field of Classification Search ..... 166/65.1, 166/106, 188, 385, 378; 439/275
See application file for complete search history.

(56) References Cited

U.S. PATENT DOCUMENTS

| | | | | |
|---|---|---|---|---|
| 902,235 | A | 10/1908 | Kellner | |
| 1,342,819 | A | 6/1920 | Lake | |
| 2,056,248 | A | 10/1936 | Buchanan | |
| 2,463,144 | A * | 3/1949 | Buchanan | 439/805 |
| 3,846,738 | A | 11/1974 | Nepovim | |
| 3,945,700 | A | 3/1976 | Didier | |
| 4,196,781 | A * | 4/1980 | Cheek | 175/61 |
| 4,728,296 | A | 3/1988 | Stamm | |
| 4,927,386 | A | 5/1990 | Neuroth | |
| 5,458,507 | A | 10/1995 | Colescott | |
| 5,868,554 | A | 2/1999 | Giacomino | |
| 7,467,979 | B2 * | 12/2008 | Colescott et al. | 439/784 |
| 2007/0034381 | A1 * | 2/2007 | Campbell et al. | 166/378 |
| 2007/0287323 | A1 | 12/2007 | Colescott | |

* cited by examiner

*Primary Examiner* — Nicole Coy

(57) ABSTRACT

An apparatus for providing electrical power through a downhole packer comprises a riser nipple engagingly insertable in a passage in the packer; a sleeve surrounding a portion of the riser nipple and slidingly moveable between a cable assembly position and an operational position enabling connection of a cable extending through the packer and the sleeve to an electrical connector; and a retaining nut engageable with the riser nipple capturing the sleeve in the operational position when the retaining nut is engaged with the riser nipple.

15 Claims, 6 Drawing Sheets

Section I-I

APPARATUS AND METHOD FOR ELECTRICAL PACKER FEEDTHROUGH

CROSS-REFERENCE TO RELATED APPLICATIONS

This application claims priority from U.S. Provisional Application 60/978,203 filed on Oct. 8, 2007.

BACKGROUND

1. Field of the Invention

The present invention relates to the field of electrical connectors and more particularly to electrical feedthroughs for downhole packers.

2. Background Information

Numerous applications involve the use of electrical connectors. High power connectors are used in applications including subsea connections, and in submersible pump connections in both water wells and oil wells. The size, weight, and orientation of the cables and connectors induce mechanical loads on connector components that make reliable mechanical and electrical connection difficult. In addition, the physical environment may include high temperature, high pressure, and abrasive and/or corrosive liquids and gases.

Packers may be used in downhole applications to seal off separate producing zones. Electrical cables may be run through packers to power downhole equipment, for example, electric submersible pumps, downhole electric actuators, and downhole electronics and sensors. In some applications, a through-packer penetrator may be used that has an electrical cable with a connector on each end. Such configurations require a special packer and may be very costly. Alternatively, cables may be vertically spliced together. Splicing operations in the field may take an inordinate amount of time and result in a less reliable connection.

SUMMARY

In one aspect of the present invention, an apparatus for providing electrical power through a downhole packer comprises a riser nipple engagingly insertable in a passage in the packer; a sleeve surrounding a portion of the riser nipple and slidingly moveable between a cable assembly position and an operational position enabling connection of a cable extending through the packer and the sleeve to an electrical connector; and a retaining nut engageable with the riser nipple capturing the sleeve in the operational position when the retaining nut is engaged with the riser nipple.

In another aspect, a method for providing electrical power through a downhole packer comprises engagingly inserting a riser nipple in a passage of the downhole packer; sliding a sleeve surrounding the riser nipple into a cable assembly position; connecting a cable extending through the packer and the sleeve to an electrical connector; sliding the sleeve to an operational position; and engaging a lock nut with the riser nipple to retain the sleeve in the operational position.

In yet another aspect, an apparatus comprises a submersible pump in a wellbore; a cable having an electrical conductor in electrical communication with the submersible pump; an electrical feedthrough assembly enabling passage of the electrical conductor through a packer in the wellbore; and a gripping contact assembly engaging the electrical conductor conducting electrical power to the submersible pump.

Non-limiting examples of certain aspects of the invention have been summarized here rather broadly in order that the detailed description thereof that follows may be better understood, and in order that the contributions they represent to the art may be appreciated. There are, of course, additional features of the invention that will be described hereinafter.

BRIEF DESCRIPTION OF THE FIGURES

For a detailed understanding of the present invention, references should be made to the following detailed description of the exemplary embodiment, taken in conjunction with the accompanying drawings, in which like elements have been given like numerals, wherein.

DETAILED DESCRIPTION

Figure 1:
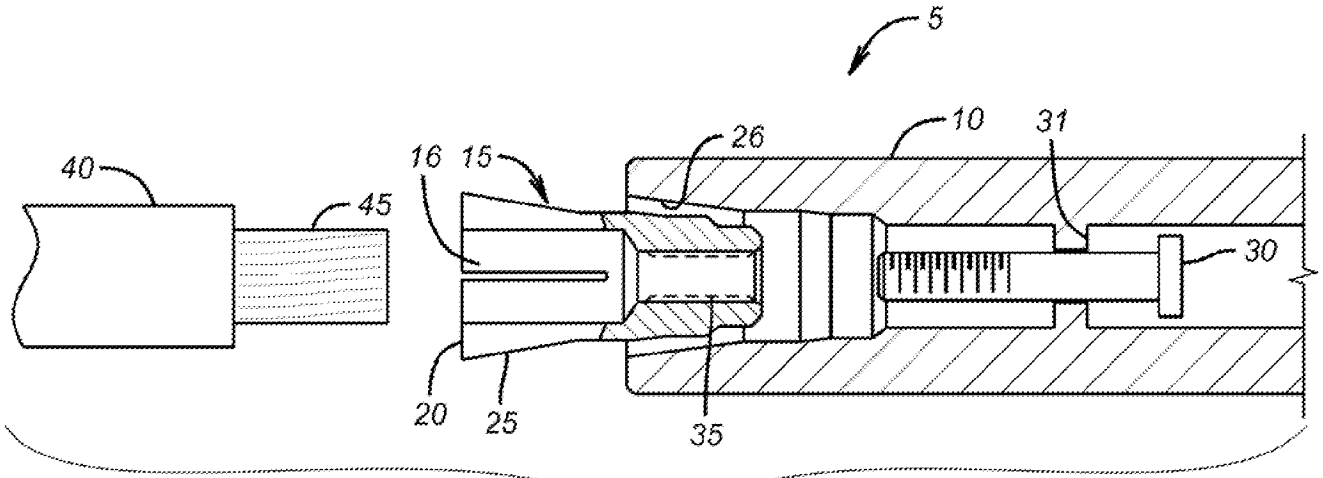
FIG. 1 shows an exploded view of a connector contact assembly according to one illustrative embodiment of the present invention.

The following description presents non-limiting examples of embodiments of the present invention. Refer now to FIGS. 1-4B. FIG. 1 shows an exploded view of a connector contact assembly 5 according to one illustrative embodiment of the present invention. As shown in FIG. 1, a cable 40 has an electrical conductor 45 therein. Electrical conductor 45 may be a solid conductor, or, alternatively, a stranded conductor.

A gripping contact 15 has a cavity 16 sized to accept electrical conductor 45. In one embodiment, the inner diameter of cavity 16 is a substantially a zero clearance fit with the outer diameter of electrical conductor 45. Gripping contact 15 (see also FIGS. 4A and 4B) comprises a plurality of gripping fingers 20 with an outer surface 25 having a substantially conical shape. As seen, in FIG. 4B, the conical surface 25 is defined by the angle β. In one embodiment, angle β is about 6°. Alternatively, angle β may be in the range of about 2° to about 10°. The internal surface 21 of fingers 20 substantially defines cavity 16. While shown in FIG. 4A as comprising four fingers, any number of fingers may be used and are intended to be encompassed by the present disclosure. In one embodiment, the internal surface 21 of fingers 20 may be substantially smooth. Alternatively, in another embodiment, the internal surface 21 of fingers 20 may have a raised pattern (not shown) formed on surface 21. Such a pattern may include, but is not limited to: a thread form, a tooth form, a knurling form, and any other raised pattern form used for gripping electrical conductor 45.

On an opposite end of gripping contact 15, an integral body 27 has an internally threaded bore 35. Gripping contact 15 may be made out of an electrically conductive metal. Examples of such an electrically conductive metal include, but are not limited to: gold, silver, copper, copper alloys, aluminum, aluminum alloys, brass, bronze, and any other suitable electrically conducting metal. The surfaces 25 and 21 of fingers 20 may be plated with a suitable electrically conductive material to reduce galling and/or wear of the gripping fingers 20. Any suitable plating may be used including, but not limited to: chrome plating, nickel plating, gold plating, and silver plating.

Figure 2:
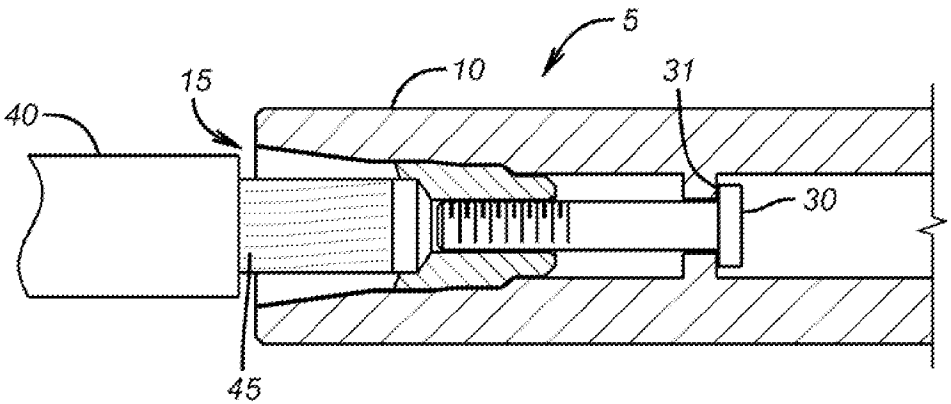
FIG. 2 shows an assembled view of the elements of FIG. 1.
Figure 3:
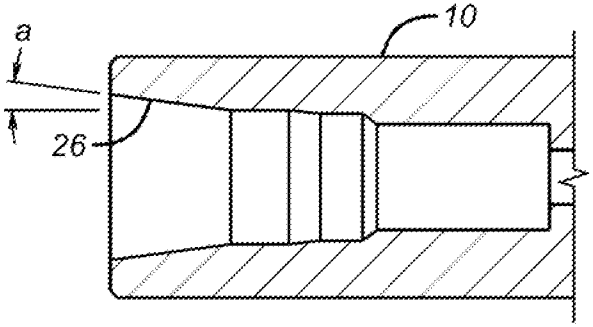
FIG. 3 shows a portion of a contact receptacle according to one illustrative embodiment of the present invention.
Figure 4B:
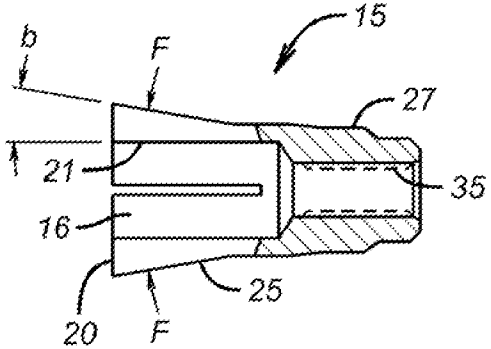
FIG. 4B shows a cross-section view along section line A-A of FIG. 4A.
Figure 4A:
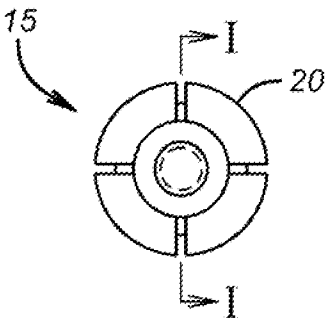
FIG. 4A shows an end view of a gripping contact according to one illustrative embodiment of the present invention.

A contact receptacle 10 (see FIGS. 1-3), has an internal conical surface 26 having an angle $\alpha$ where $\alpha \leqq \beta$. In one embodiment, $\alpha$ is on the order of 1.0° smaller than $\beta$. Alternatively, $\alpha$ may be smaller than $\beta$ from about 0.5° to about 1.5°. The difference in angles ensures that fingers 20 of gripping contact 15 are forced to collapse around and compress electrical conductor 45, as shown in FIGS. 1 and 2, when gripping contact 15 is urged axially into contact receptacle 10. Contact receptacle 10 may be made from any of the materials as described previously for gripping contact 15. Similarly, contact receptacle 10 may be plated by any of the platings discussed previously with respect to gripping contact 15.

As shown in FIGS. 1 and 2, threaded element 30 engages threads 35 in gripping contact 15 and, under tension, reacts against shoulder 31 in contact receptacle 10 such that gripping contact 15 is axially urged into contact receptacle 10. This motion causes interaction between outer surface 25 and inner surface 26 such that fingers 20 of gripping contact 15 are forced to collapse around and compress electrical conductor 45 along substantially the length of the extension of electrical conductor 45 into gripping contact 15. The use of threaded element 30 provides a substantially repeatable force urging gripping contact 15 into contact receptacle 10, thereby providing a repeatable holding force between electrical contact 45 and connector contact assembly. In addition, the substantially repeatable axial holding force provides a repeatable electrical contact between fingers 20 of gripping contact 15 and both electrical conductor 45 and contact receptacle 10. Threaded element 30 may be a suitably sized threaded fastener that may be commercially available. Alternatively, threaded element 30 may be designed for this particular application using techniques known in the art.

Figure 5:
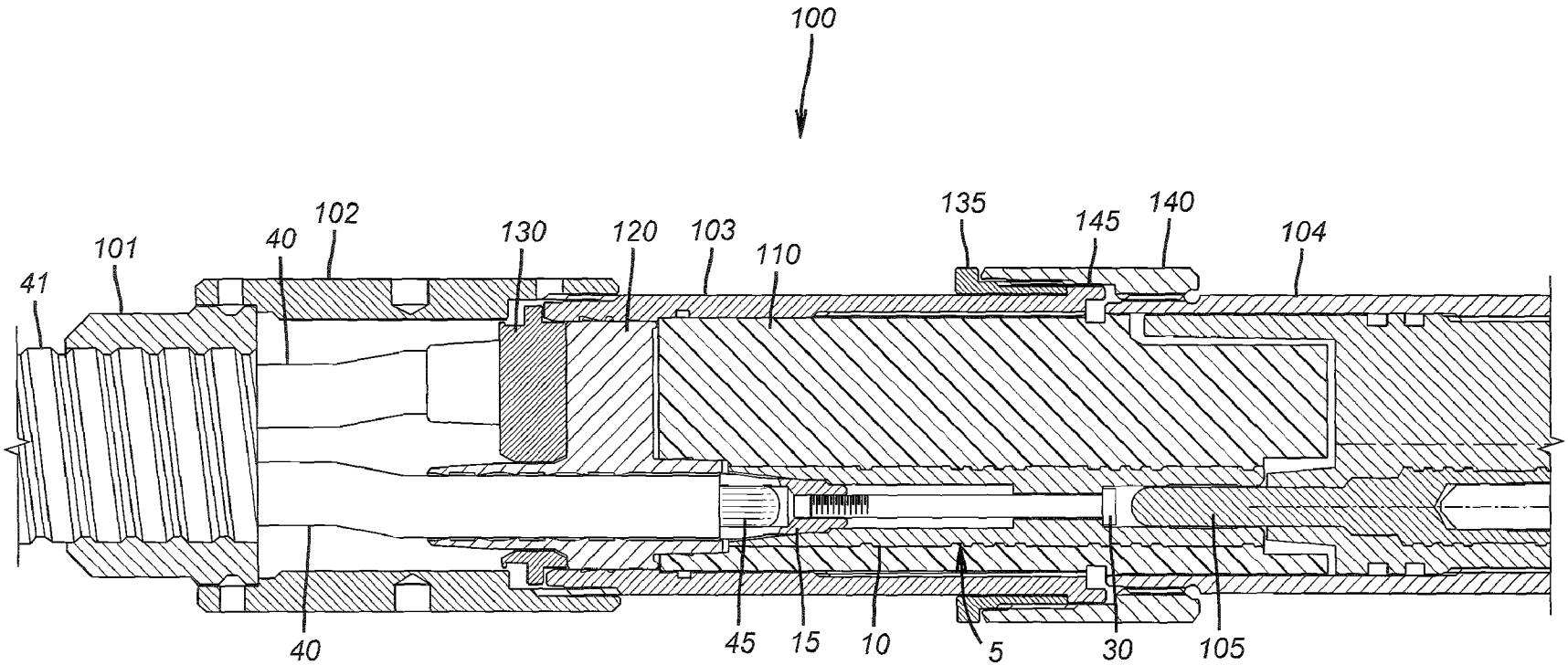
FIG. 5 shows a non-limiting example of a portion of a connector assembly according to one illustrative embodiment of the present invention.

FIG. 5 depicts a non-limiting example of a portion of a connector assembly 100 according to one illustrative embodiment of the present invention. Connector assembly 100 may be a power connector for use in connecting a power source to a submersible pump in a well. Alternatively, connector assembly 100 may be a sub-sea connector. As shown in FIG. 5, a multi-conductor armored cable assembly 41 has at least one insulated cable 40 with an internal electrical conductor 45. Armored cable assembly 41 is connected to connector assembly 100 by cable adapter 101. Crossover 102 connects cable adapter 101 to lower housing 103.

It will be appreciated by one skilled in the art that the portion of connector assembly 100 shown in FIG. 5 may be immersed in a high pressure fluid such as, for example, a wellbore fluid. To seal high pressure fluid from the internal electrical connections, cable 40 is inserted through seal 120. Seal 120 is an elastomer seal that is compressed around the insulation of cable 40 to preclude passage of fluid toward the electrical contacts 15 and 10. Seal 120 is held in place by follower 130. Seal 120 may be made of a suitable elastomer. Suitable elastomers include but are not limited to, natural rubber, synthetic rubber, fluoroelastomers, perfluoroelastomers, ethylene propylene diene rubber, and any other suitable elastomer.

Connector contact assembly 5 is inserted into an insulator 110 that is located above seal 120. As shown, connector contact assembly 5 comprises gripping contact 15 assembled in contact receptacle 10 and held in place by threaded element 30. To better facilitate field assembly, insulator 110 is located in lower housing 103 and upper housing 104 that are connected through coupling nut 140 and shoulder nut 135 acting against shoulder 145. Insulator 110 may be a thermoplastic suitable for the particular environment encountered. Examples of such a thermoplastic include, but are not limited to, a polyetheretherketone material and a glass-filled polyetheretherketone material. Gripping contact 15 is in engaged contact, both mechanically and electrically with electrical conductor 45. Connector assembly 5 conducts an electrical power signal to contact 105 which is electrically conducted to a surface power control system. One skilled in the art will appreciate that the connector assembly 5 and its components may be appropriately scaled to fit different size electrical conductors without undue experimentation.

Figure 6:
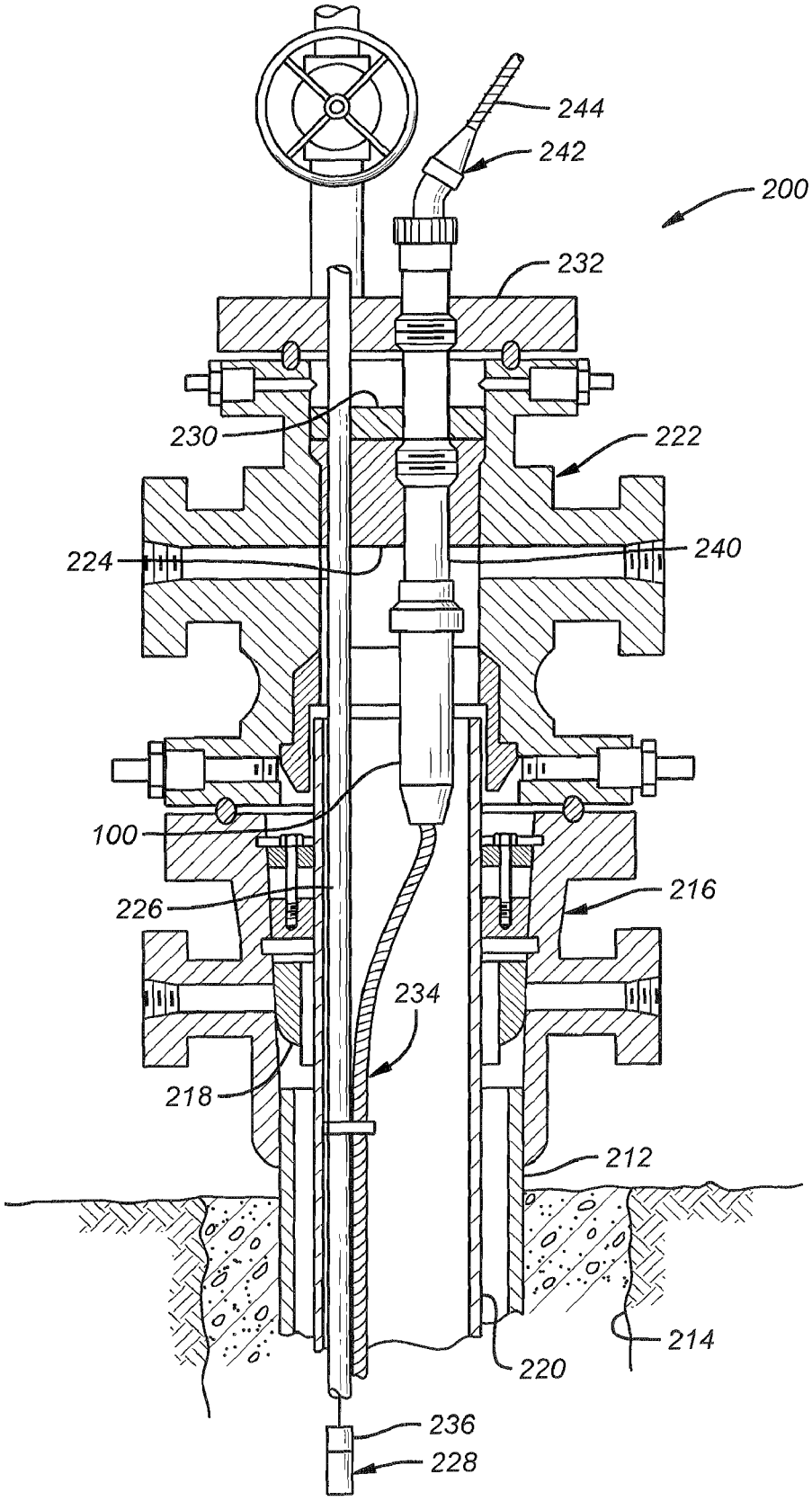
FIG. 6 shows a non-limiting example of a connector utilizing a contact assembly of one embodiment of the present invention to connect power to a submersible pump.

One non-limiting example of an application of the present invention is shown in FIG. 6. In FIG. 6, a well 200 comprises a string of surface pipe 212 cemented in the upper portion of a bore hole 214 which extends into the earth to a location adjacent and usually below a subterranean oil productive formation (not shown). A wellhead 216 attaches to the surface pipe 212. A set of slips 218 suspends a casing string 220 inside the bore hole 214 which is also cemented in place. A casing head 222 connects to the upper end of the casing string 220 and includes a tubing hanger 224.

A tubing string 226 is suspended from the tubing hanger 224 and extends downwardly inside the casing string 220 to a location adjacent the productive formation. An electrically powered submersible pump 228, of any suitable type, on the lower end of the tubing string 226 pumps oil or an oil-water mixture from the inside of the casing string 220 upwardly through the tubing string 226.

Electric power is delivered to the downhole pump 228 through an armored cable 234 connected to a motor 236 comprising part of the submersible pump 228. The cable 234 extends upwardly in the well 200 to a connector 100 of the present invention located immediately below the tubing hanger 224. The connector 100 is secured to a mandrel or feed through socket 240 extending through the hanger 224, seal assembly 230 and flange 232. The connector 100 employs a contact assembly as described previously. In one embodiment, a pig tail connector 242 attaches the mandrel 240 to a power cable 244 extending to a source of power at the surface.

Figure 7:
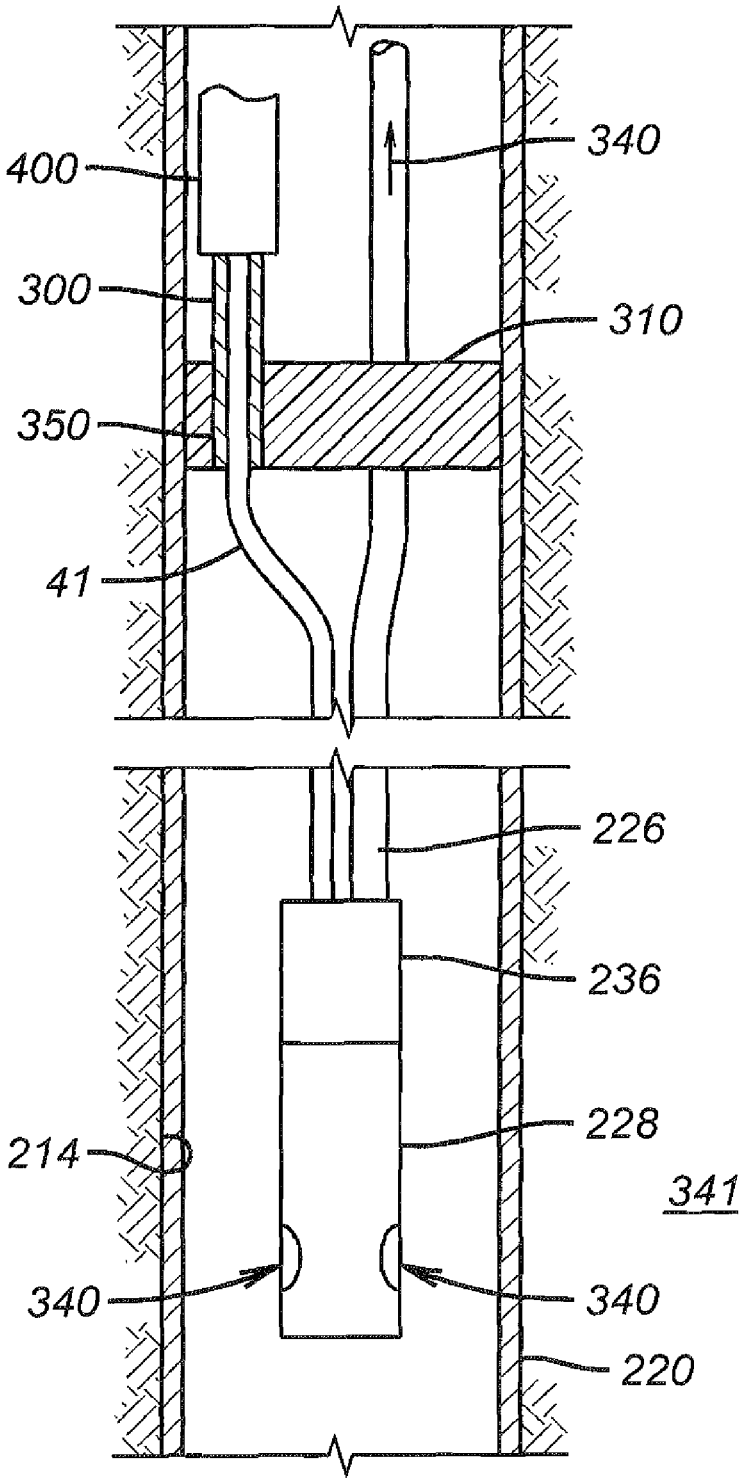
FIG. 7 shows an example of an electrical feedthrough used in a downhole submersible pump application.

FIG. 7 shows an example of a downhole pump application where a packer is located uphole of the pump. Electrical submersible pump 228 is powered by electric motor 236 and is located proximate a producing formation 341. Reservoir fluid 340 enters pump 228 and is forced up tubing string 226 to a surface system, for example, wellhead 216 in FIG. 6 for distribution to surface storage and/or processing systems (not shown). Packer 310 is located uphole of pump 228 and may be expanded to seal off the volume of borehole 214 above packer 310 to the volume below packer 310. Packer 310 seals against tubing string 226 where the tubing string passes through packer 310.

Armored electrical cable 41 extends from motor 236 upward and through a passage 350 through packer 310. Cable 41 extends through packer feedthrough assembly 300 and may be electrically connected to electrical connector 400 which may be an electrical connector as described above in FIGS. 1-5. Alternatively, cable 41 may be electrically connected to any suitable electrical connector adapted to interface with feedthrough assembly 300. Electrical connector 400 may facilitate electrical connection to a suitable power and/or control system (not shown) at the surface.

Figure 8:
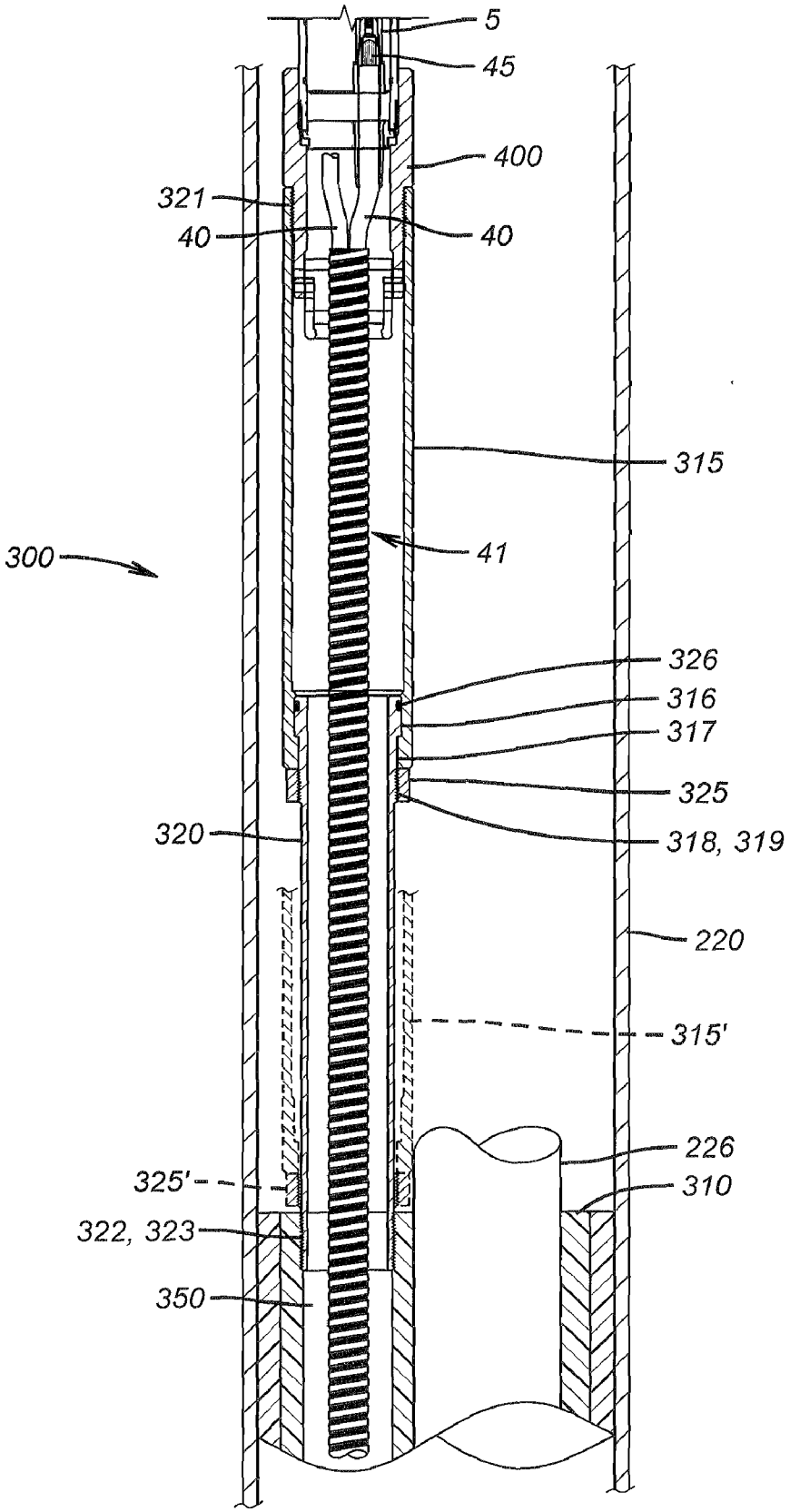
FIG. 8 shows an enlarged view of the example electrical feedthrough of FIG. 7.

FIG. 8 shows an enlarged view of the example electrical feedthrough of FIG. 7. As shown in FIG. 7, electrical feedthrough assembly 300 comprises riser nipple 320, sliding sleeve 315, and retaining nut 325. Riser nipple 320 comprises a lower end having thread 322 formed thereon, and an upper end having an upset 316 formed thereon. Threads 322 on the lower end of riser nipple 320 are engageably inserted into threads 323 formed in a sleeve formed in packer 310. The outer diameter of the upset 316 on riser nipple 320 fits closely in the inner diameter of sliding sleeve 315 such that elastomer seal 326 substantially excludes wellbore fluids from entering the clearance gap between the outer diameter of upset 316 and the inner diameter of sliding sleeve 315. Sliding sleeve 315 has a shoulder section 317 on a lower end thereof. Retaining nut 325 has thread 318 formed on an inner diameter thereof. In an operational position, retaining nut 325 is threaded onto threads 319 on an outer diameter of riser nipple 320 such that retaining nut 325 captures shoulder section 317 of sliding sleeve 315 against upset 316 of riser nipple 320.

In a cable assembly position, sliding sleeve 315 has an open upper end. Retaining nut 325 is unthreaded from riser nipple 320 and moved to position 325' shown in FIG. 8. Likewise, sliding sleeve 315 is moved down to position 315'. In this configuration, a sufficient length of cable 41 is exposed above packer 310 to allow the cable to be stripped and dressed for connection of conductor 45 of each individual cable element 40 to a suitable contact receptacle, for example, gripping contact assembly 5 of FIG. 1. Gripping contact assembly 5 may then assembled in connector 400, which in one embodiment is similar to connector 100 shown in FIG. 5. Alternatively, any suitable connector may be used.

Upon connection of conductors 45 to a suitable connector 400, sliding sleeve 315 is raised to the upper operational position and connected to connector 400, for example, at threaded connection 321. Retaining nut 325 is moved upward and threaded onto riser nipple 320 by engaging threads 318 and 319. Retaining nut 325 forces shoulder section 317 of sliding sleeve 315 against upset 316 of riser nipple 320 thereby capturing sliding sleeve 315 in the operational position. The packer electrical feedthrough and method of assembly described herein is intended to provide a substantial reduction in assembly time of a field connection while also providing enhanced reliability over spliced connections.

While the foregoing disclosure is directed to the non-limiting embodiments of the invention, various modifications will be apparent to those skilled in the art. It is intended that all variations within the scope of the appended claims be embraced by the foregoing disclosure.

What is claimed is:

1. An apparatus for providing electrical power through a downhole packer comprising:

a riser nipple engagingly insertable in a passage in the packer;

a sleeve surrounding a portion of the riser nipple and slidingly moveable between a cable assembly position and an operational position enabling connection of a cable extending through the packer and the sleeve to an electrical connector; and a retaining nut engageable with the riser nipple capturing the sleeve in the operational position when the retaining nut is engaged with the riser nipple;

a gripping contact having a plurality of fingers, the plurality of fingers having a substantially conical outer surface;

a contact receptacle having a substantially conical inner surface; and a male threaded tension member to threadedly engage the gripping contact and to pull the gripping contact into the contact receptacle such that interaction between the substantially conical outer surface and the substantially conical inner surface forces the plurality of fingers to engagingly compress an electrical conductor of the cable when placed between the fingers.

2. The apparatus of claim 1, wherein the substantially conical outer surface comprises a first angle of about 6 degrees.

3. The apparatus of claim 1, wherein the substantially conical outer surface comprises a first angle in the range of about 2 degrees to about 10 degrees.

4. The apparatus of claim 1, wherein the substantially conical inner surface comprises a second angle that is less than the first angle by about 1.0 degree.

5. The apparatus of claim 1, wherein the substantially conical inner surface comprises a second angle that is less than the first angle within a range of about 0.5 degree to about 1.5 degrees.

6. The apparatus of claim 1, wherein the gripping contact is made from an electrically conductive metal.

7. The apparatus of claim 1, wherein the contact receptacle is made from an electrically conductive metal.

8. A method for providing electrical power through a downhole packer comprising:

engagingly inserting a riser nipple in a passage of the downhole packer;

sliding a sleeve surrounding the riser nipple into a cable assembly position;

connecting a cable extending through the packer and the sleeve to an electrical connector;

sliding the sleeve to an operational position;

engaging a lock nut with the riser nipple to retain the sleeve in the operational position;

inserting an electrical conductor of the cable between a plurality of fingers of a gripping contact, the plurality of fingers having a substantially conical outer surface; and actuating a male threaded tension member threadedly engaged with the gripping contact to pull the gripping contact into the contact receptacle such that the substantially conical outer surface of the gripping contact to interact with a substantially conical inner surface of a contact receptacle such that the interaction forces the plurality of fingers to engage the electrical conductor.

9. The method of claim 8, wherein the substantially conical outer surface comprises a first angle of about 6 degrees.

10. The method of claim 8, wherein the substantially conical outer surface comprises a first angle in the range of about 2 degrees to about 10 degrees.

11. The method of claim 8, wherein the substantially conical inner surface comprises a second angle that is less than the first angle by about 1.0 degree.

12. The method of claim 8, wherein the substantially conical inner surface comprises a second angle that is less than the first angle within a range of about 0.5 degree to about 1.5 degrees.

13. An apparatus comprising:

a submersible pump in a wellbore;

a cable having an electrical conductor in electrical communication with the submersible pump;

an electrical feedthrough assembly enabling passage of the electrical conductor through a packer in the wellbore; and a gripping contact assembly engaging the electrical conductor conducting electrical power to the submersible pump, wherein the gripping contact assembly comprises;

a gripping contact having a plurality of fingers, the plurality of fingers having a substantially conical outer surface;

a contact receptacle having a substantially conical inner surface; and a male threaded tension member to threadedly engage the gripping contact to pull the gripping contact into the contact receptacle such that interaction between the substantially conical outer surface and the substantially conical inner surface forces the plurality of fingers to engagingly compress the electrical conductor placed between the fingers.

14. The apparatus of claim 13 wherein the electrical feedthrough comprises:

a riser nipple engagingly insertable in a passage in the packer;

a sleeve surrounding a portion of the riser nipple and slidingly moveable between a cable assembly position and an operational position enabling connection of a cable extending through the packer and the sleeve to an electrical connector; and a retaining nut engageable with the riser nipple capturing the sleeve in the operational position when the retaining nut is engaged with the riser nipple.

15. The apparatus of claim 13, wherein the substantially conical outer surface comprises a first angle in the range of about 2 degrees to about 10 degrees, and the substantially conical inner surface comprises a second angle that is less than the first angle within a range of about 0.5 degree to about 1.5 degrees.

* * * * *